US010113745B2

(12) United States Patent
Torkaman et al.

(10) Patent No.: US 10,113,745 B2
(45) Date of Patent: Oct. 30, 2018

(54) FLOW SLEEVE DEFLECTOR FOR USE IN GAS TURBINE COMBUSTOR

(71) Applicant: ANSALDO ENERGIA SWITZERLAND AG, Baden (CH)

(72) Inventors: Alex Torkaman, Port St. Lucie, FL (US); Gregory Vogel, Palm Beach Gardens, FL (US); Richard Whiting, Palm Beach Gardens, FL (US); Jeff Tessier, Jupiter, FL (US); Wes Smith, West Palm Beach, FL (US)

(73) Assignee: ANSALDO ENERGIA SWITZERLAND AG (CH)

( * ) Notice: Subject to any disclaimer, the term of this patent is extended or adjusted under 35 U.S.C. 154(b) by 665 days.

(21) Appl. No.: 14/669,307

(22) Filed: Mar. 26, 2015

(65) Prior Publication Data

US 2016/0281987 A1 Sep. 29, 2016

(51) Int. Cl.

| | |
|---|---|
| ***F23R 3/00*** | (2006.01) |
| ***F23R 3/06*** | (2006.01) |
| ***F23R 3/02*** | (2006.01) |

(52) U.S. Cl.

CPC ..... *F23R 3/002* (2013.01); *F23R 3/005* (2013.01); *F23R 3/02* (2013.01); *F23R 3/06* (2013.01); *F23R 2900/03044* (2013.01)

(58) Field of Classification Search

CPC .. F23R 3/002; F23R 3/005; F23R 3/02; F23R 3/04; F23R 3/06; F23R 3/08; F23R 3/16; F23R 2900/03044

USPC ..... 60/752, 755, 757, 758

See application file for complete search history.

(56) References Cited

U.S. PATENT DOCUMENTS 5,467,815 A * 11/1995 Haumann ..... F01P 1/02 165/109.1

8,291,711 B2 * 10/2012 Chokshi ..... F23R 3/06 60/758

* cited by examiner

*Primary Examiner* — Phutthiwat Wongwian
*Assistant Examiner* — Loren Edwards
(74) *Attorney, Agent, or Firm* — Hovey Williams LLP

(57) ABSTRACT

An apparatus for providing improved cooling to a combustion liner of a gas turbine combustor is provided. A plurality of flow deflectors is secured to a flow sleeve in order to improve the flow of impingement air from a flow sleeve to the combustion liner outer surface, such that the amount of impingement air being swept away by a cross flow of cooling air is reduced.

16 Claims, 9 Drawing Sheets

FLOW SLEEVE DEFLECTOR FOR USE IN GAS TURBINE COMBUSTOR

CROSS-REFERENCE TO RELATED APPLICATIONS

None.

TECHNICAL FIELD

The present invention relates to an apparatus for improved cooling of a combustion liner in a gas turbine combustor or other turbo machinery applications. The present invention offers several practical applications in the technical arts, not limited to gas turbine combustors.

BACKGROUND OF THE INVENTION

Gas turbine engines are typically used in power plant applications for the purpose of generating electricity. A typical gas turbine engine is comprised of a plurality of combustors, which are arranged in an annular array around a centerline of the engine. The combustors are then provided pressurized air from a compressor of the gas turbine engine. The pressurized air is mixed with fuel and the mixture is ignited to produce high temperature combustion gases. These high temperature combustion gases exit the combustors and enter a turbine, where the energy of the pressurized combustion gases causes the turbine to rotate. The rotational energy of the turbine is then transmitted, via a shaft, to the compressor and to a generator, for the purpose of generating electricity.

A combustor is typically comprised of at least a pressurized case, a combustion liner, and a transition piece. The combustion liner and transition piece, which contain the high temperature reaction of fuel and air, are subject to thermal degradation. As such, they must be actively cooled to prevent or reduce the degradation rate. In order to actively cool the combustion liner and transition piece, a portion of the compressed air flow is directed through the pressurized case and towards the outer surface of the combustion liner and transition piece, in a generally perpendicular direction, in order to cool these components.

In prior art configurations of gas turbine combustors, exhausted cooling air from the transition piece flows parallel to the surface of the combustion liner mixing with the air being directed through cooling apertures (and towards the outer surface of the combustor liner). Due to the difference in direction of the two air streams, the mixing of the two streams takes place near the surface of the combustor liner. This mixing effect causes the velocity of the air flow perpendicular to surface of the combustor liner (through the cooling apertures) to be reduced. This lowered air flow velocity perpendicular to the surface of the combustor liner leads to less effective cooling of the combustor liner, further accelerating thermal degradation of the combustor liner. Thermal degradation of the liner can lead to premature repair or complete replacement of the liner.

Referring to FIG. 1, a cross sectional perspective view of a prior art gas turbine combustor is shown having a combustion liner 100 encompassed by a flow sleeve 102, forming a flow annulus 104 therebetween. The flow sleeve 102 is provided with a plurality of impingement holes 106, for the purposes of cooling combustion liner 100 on its surface. FIG. 1 also depicts a portion of a gas turbine combustor transition piece 108, which includes an outer mounting flange 110 for coupling the transition piece 108 to the flow sleeve 102 and an inner mounting interface for coupling the transition piece 108 to the combustion liner 100.

Referring now to FIG. 2, a cross sectional view of a portion of the liner 100 and flow sleeve 102 of FIG. 1 is depicted. As discussed above, a generally cylindrical combustion liner 100 and flow sleeve 102 are provided, forming a flow annulus 104 therebetween. Located along the length of flow sleeve 102 is a plurality of impingement holes 106. In a gas turbine combustor, impingement holes 106 are located along a portion of the flow sleeve 102 for providing an impingement flow 112 onto the outer surface of combustion liner 100. Additionally, prior art gas turbine combustors are known to have a cross flow 114 exiting from the transition piece 108 flow annulus and travelling parallel to the outer surface of combustor liner 100. Because the impingement flow 112 and cross flow 114 are generally perpendicular to one another, a substantial portion of cooling impingement flow 112 is turned by the cross flow 114 and is inhibited from reaching the outer surface of the combustor liner 100, as the cross flow 114 significantly reduces the perpendicular velocity component of impingement flow 112.

BRIEF SUMMARY OF THE INVENTION

The present invention relates generally to systems and methods for cooling the combustion liner of a gas turbine combustor. The air flow directed through the cooling apertures is aimed to travel radially and impinge upon the outer surface of the combustor liner. The flow annulus contains an additional high velocity air flow stream travelling axially along the length of the gas turbine combustor. Near the surface of the combustor liner, the radial air flow being directed through the cooling apertures mixes with the axial air flow along a portion of the length of the gas turbine combustion liner. In order to lessen the effects of mixing between the radial and axial flows, a plurality of flow deflectors are provided which discourage the axial flow from mixing with the radial cooling flow entering through apertures in the flow sleeve by directing the axial flow in a radially outward direction and away from the outer surface of the combustion liner.

In an embodiment of the present invention, a gas turbine combustion system comprises a transition piece, a combustion liner, a flow sleeve coaxial to the combustion liner forming a flow annulus therebetween, and a plurality of rows of circumferentially spaced cooling apertures. The combustion system has one or more flow deflectors secured to the flow sleeve and extending radially inward from the flow sleeve forming an axially elongated flow channel. The one or more flow deflectors have two sidewalls connected by a forward wall, each sidewall having a radially inward edge and a radially outward edge, the radially outward edge adjacent the flow sleeve, a first distance separates the radially inward edges and a second distance separates the radially outward edges, the first distance being greater than the second distance.

In an alternate embodiment of the present invention, a flow sleeve is provided for a gas turbine combustor comprising a generally cylindrical body, a plurality of cooling apertures located along the cylindrical body, and a plurality of flow deflectors fixed to an inner wall of the generally cylindrical body. The flow deflectors comprise a pair of radially inwardly-extending sidewalls having an axial length connected by a rounded front leading edge wall. The front leading edge may have an axially forward extending or an axially backward extending portion. The pair of sidewalls have radially inward edges and radially outward edges, the radially outward edges adjacent the flow sleeve, where the distance between the radially inward edges of the flow deflector walls is larger than the distance between the radially outward edges of the flow deflector walls.

In yet another embodiment of the present invention, a flow deflector for use in a gas turbine combustor is provided. The flow deflector comprises a first wall, a second wall spaced a distance from the first wall, and a leading edge wall connecting the first wall and the second wall to form a generally U-shaped elongated flow channel for encompassing a plurality of cooling apertures.

BRIEF DESCRIPTION OF THE SEVERAL VIEWS OF THE DRAWING

The present invention is described in detail below with reference to the attached drawing figures, wherein.

DETAILED DESCRIPTION OF THE INVENTION

The subject matter of the present invention is described with specificity herein to meet statutory requirements. However, the description itself is not intended to limit the scope of this patent. Rather, the inventors have contemplated that the claimed subject matter might also be embodied in other ways, to include different components, combinations of components, steps, or combinations of steps similar to the ones described in this document, in conjunction with other present or future technologies.

In the following description of embodiments of the present invention, specific terms relating to locations on the gas turbine combustor are included. The terms that are used, such as "cross flow" and "impingement flow" are used for convenience as understood by one skilled in the art, and in reference to the provided figures.

Figure 2:
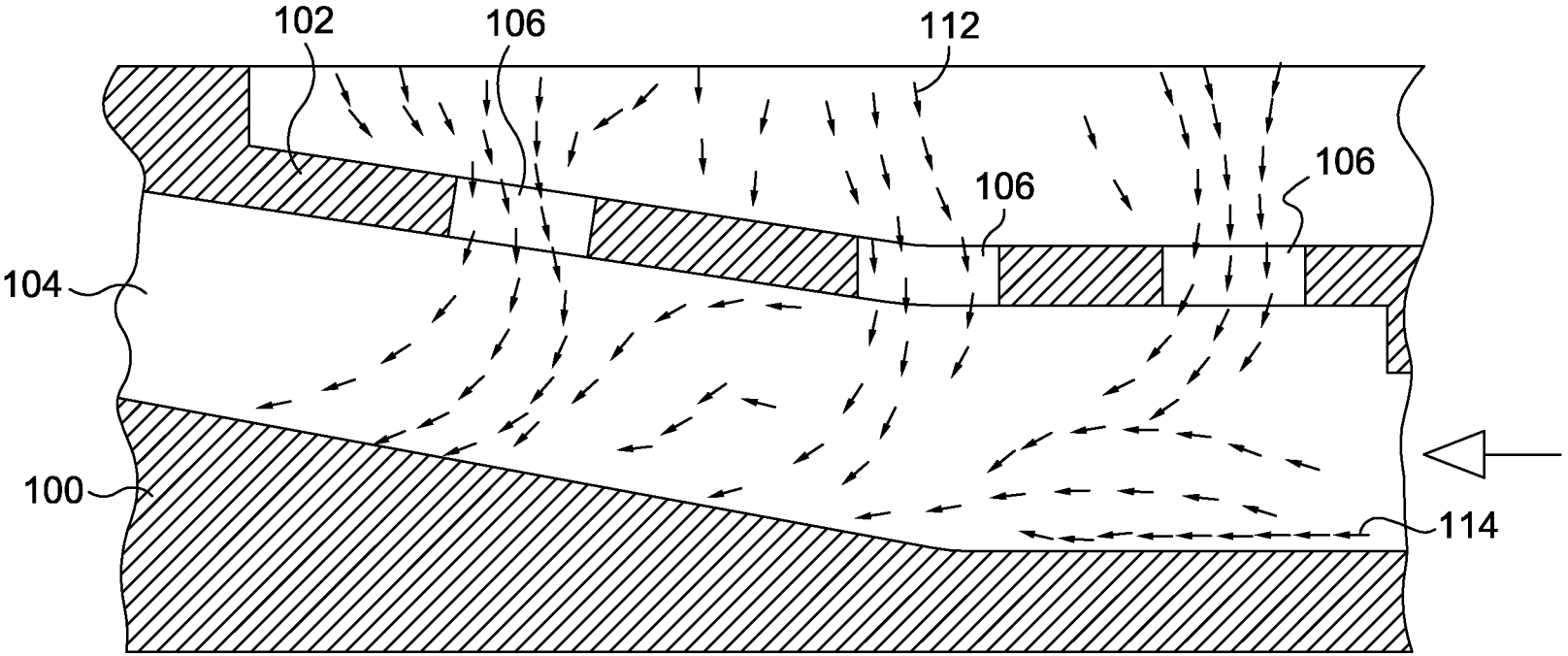
FIG. 2. PRIOR ART
FIG. 2 illustrates a cross-sectional view of a portion of the gas turbine combustor of FIG. 1 and a representation of flow conditions in accordance with the prior art.
Figure 3:
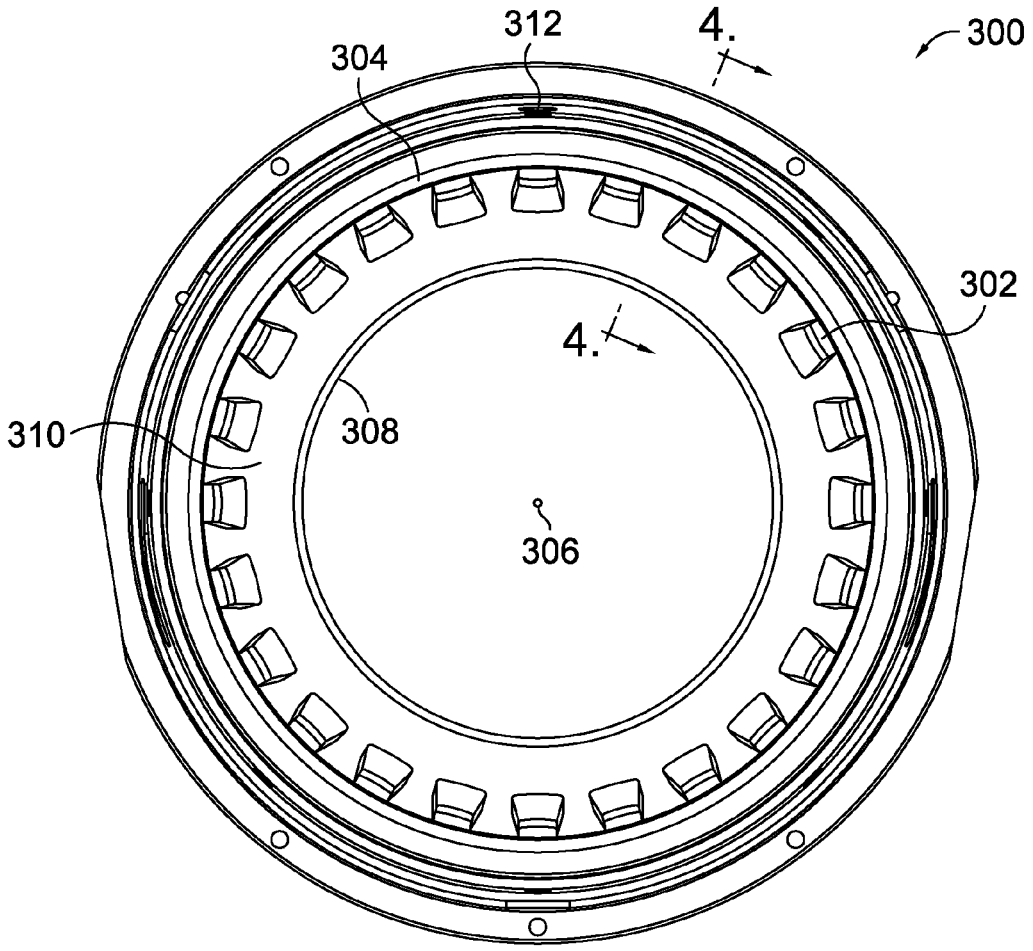
FIG. 3 illustrates an axial view of a gas turbine combustor incorporating an embodiment of the present invention.
Figure 4:
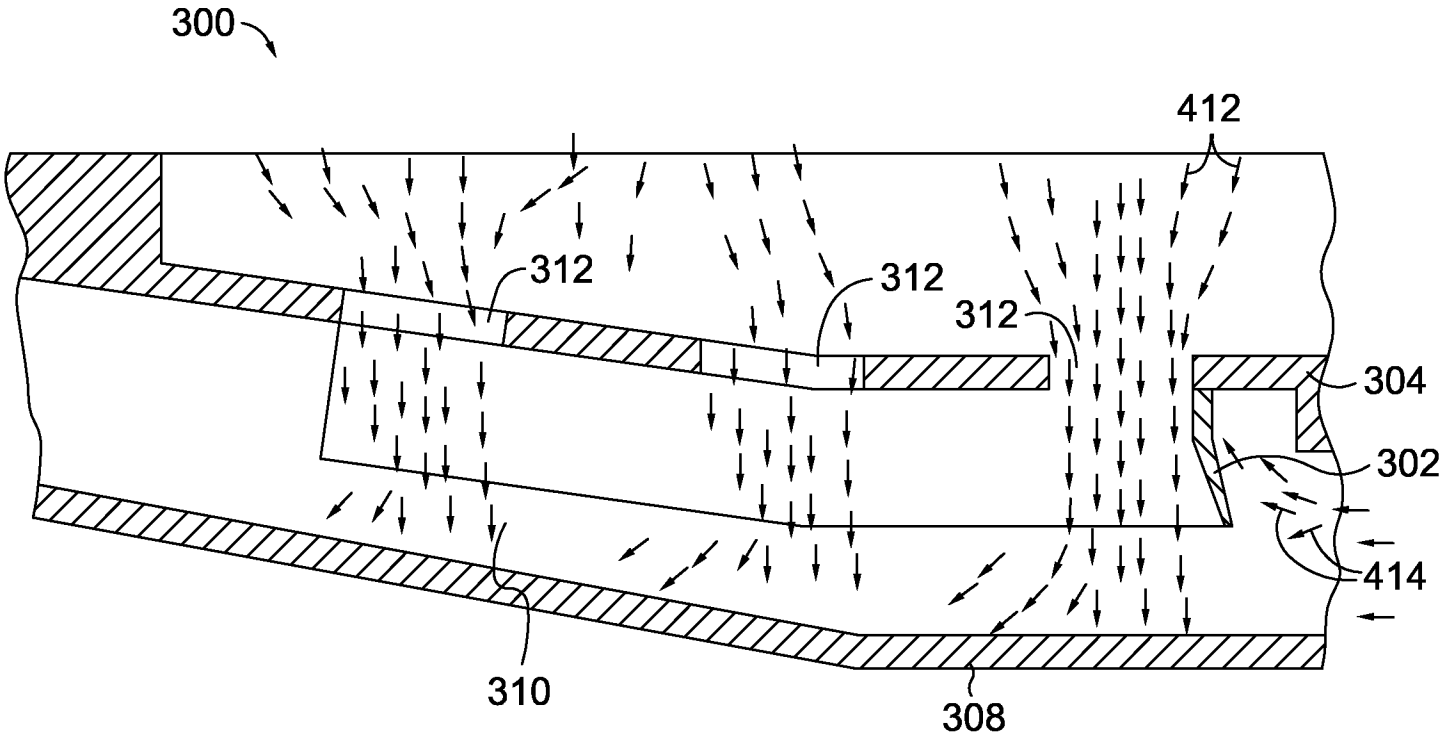
FIG. 4 illustrates a cross-sectional view of a portion of the gas turbine combustor of FIG. 3 and a representation of flow conditions in accordance with an embodiment of the present invention.
Figure 5:
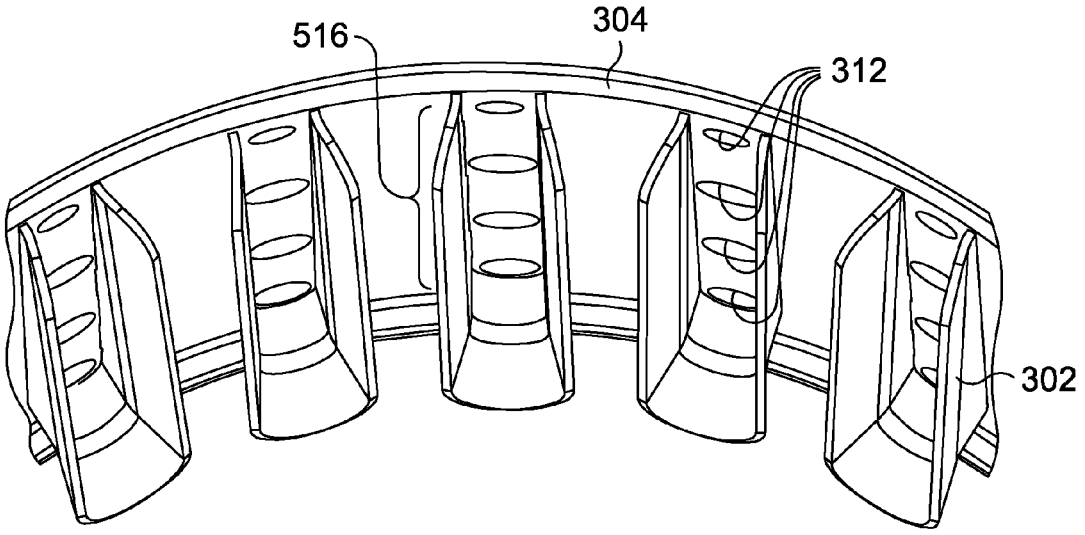
FIG. 5 illustrates a perspective view of a portion of the gas turbine combustor of FIG. 3.
Figure 6:
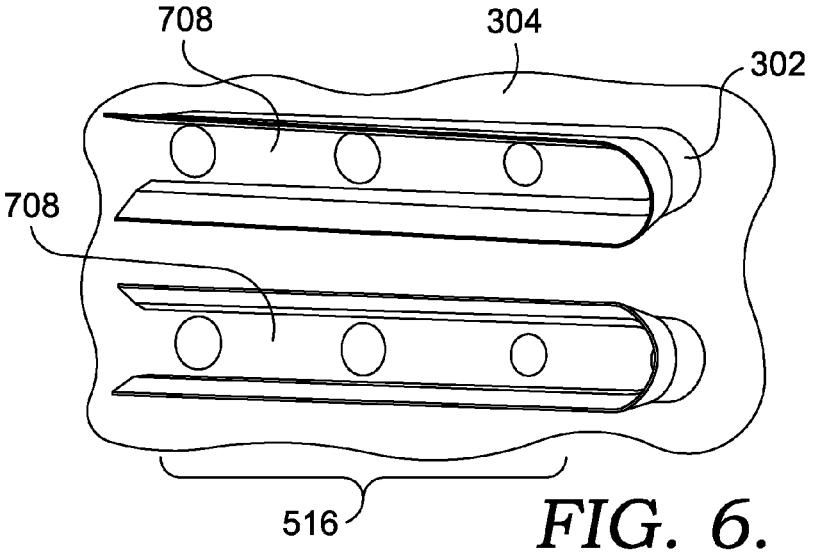
FIG. 6 illustrates an elevation view of a portion of the gas turbine combustor of FIG. 5.

The present invention is shown in FIGS. 3-11 and is directed generally towards a system for improving cooling within a gas turbine combustor. Referring initially to FIG. 3, an axial view of a gas turbine combustor 300 incorporating the present invention is depicted. In FIG. 3, a plurality of flow sleeve deflectors 302 are installed in the flow sleeve 304 and extend radially inward towards an axis 306. The plurality of flow sleeve deflectors 302 depicted in FIG. 3 are patterned radially around the inner surface of the flow sleeve 304. Located within the flow sleeve 304 is a combustion liner 308, thereby forming a first flow annulus 310 therebetween. Also depicted in FIGS. 3 and 4 is a plurality of apertures or impingement holes 312. Rows of impingement holes 312 are patterned about the circumference of flow sleeve 304 to form a plurality of impingement hole rows 516, as shown in FIGS. 5 and 6. Therefore, it is contemplated that the number of flow sleeve deflectors 302 installed within the flow sleeve 304 as well as their respective size and shape may vary depending on the number of rows of impingement holes 312. It is to be understood that the axial view of gas turbine combustor 300 in FIG. 3 is looking in the direction of an oncoming transition piece "cross flow" as depicted in FIG. 2.

Figure 1:
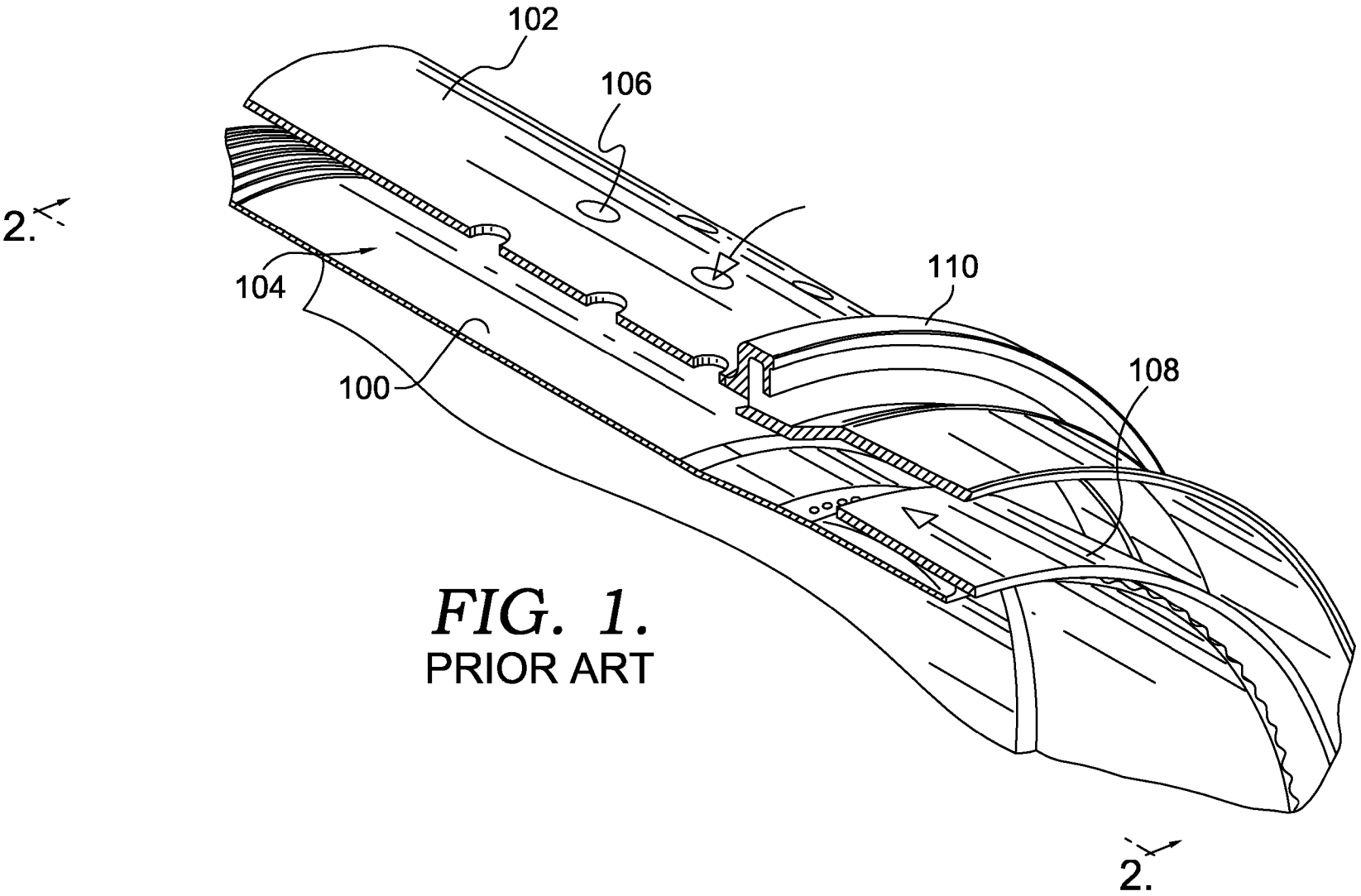
FIG. 1. PRIOR ART
FIG. 1 illustrates an isometric view of a portion of a gas turbine combustor in accordance with the prior art.

Referring now to FIG. 4, a partial cross sectional view of a portion of the gas turbine combustor 300 is shown. It is to be understood that FIG. 4 represents a similar operating condition as that depicted in FIG. 1, with the flow sleeve deflector 302 installed to improve cooling to the combustion liner 308. The space between the flow sleeve 304 and the combustion liner 308 is referred to as a first flow annulus 310. Additionally, a plurality of impingement holes 312 are located within flow sleeve 304, for the purposes of providing combustion liner 308 with cooling impingement flow 412. In FIG. 4, impingement flow 412 is directed onto the outer surface of the combustion liner 308, while a cross flow 414 is directed in a radially outward direction and away from the outer surface of the combustion liner 308. In this embodiment of the present invention, flow sleeve deflector 302 redirects cross flow 414 such that impingement flow 412 can better contact the outer surface of combustion liner 308. While cross flow 414 is present, its impact on impingement flow 412 is dramatically reduced. In this embodiment, flow sleeve deflector 302 substantially reduces the distance the impingement flow 412 has to travel while directly exposed to perpendicular cross flow 414. Therefore, flow sleeve deflector 402 is generally described as "shielding" impingement flow 412 from cross flow 414.

There are significant benefits from additional impingement flow 412 impeding upon the surface of combustion liner 308. In prior art gas turbine combustor configurations, air streams have been known to be ineffective in maintaining active cooling to the combustion liner. In these prior art configurations, thermal degradation and damage of the combustion liner is common. Due to improved cooling effectiveness provided by the present invention, significant improvement in heat transfer rates between the combustion liner 308 and impingement flow 412 is achieved. In turn, the present invention will greatly increase the durability of combustion liners in gas turbine combustors.

FIG. 5 depicts a perspective view of a portion of the flow sleeve 304. Also seen in FIG. 5 is a plurality of flow sleeve deflectors 302 in accordance with an embodiment of the present invention. As it can be seen from FIG. 5, the impingement holes 312 extend generally along a portion of the flow sleeve 304, forming a plurality of impingement rows 516. Furthermore, as shown in FIG. 5, the flow sleeve deflector 302 surrounds or encompasses each impingement hole 312 within a row 516. While the deflector 302 is shown encompassing one row 516 of impingement holes 312, it is possible in alternate embodiments that the deflector 302 could encompass multiple rows 516. Referring now to FIG. 6, a view of the flow sleeve 304 looking into the area contained by the deflector 302 is shown. From FIG. 6, it can be seen that the width of the flow deflector 302 is greater than the diameter of the impingement hole 312.

Figure 7:
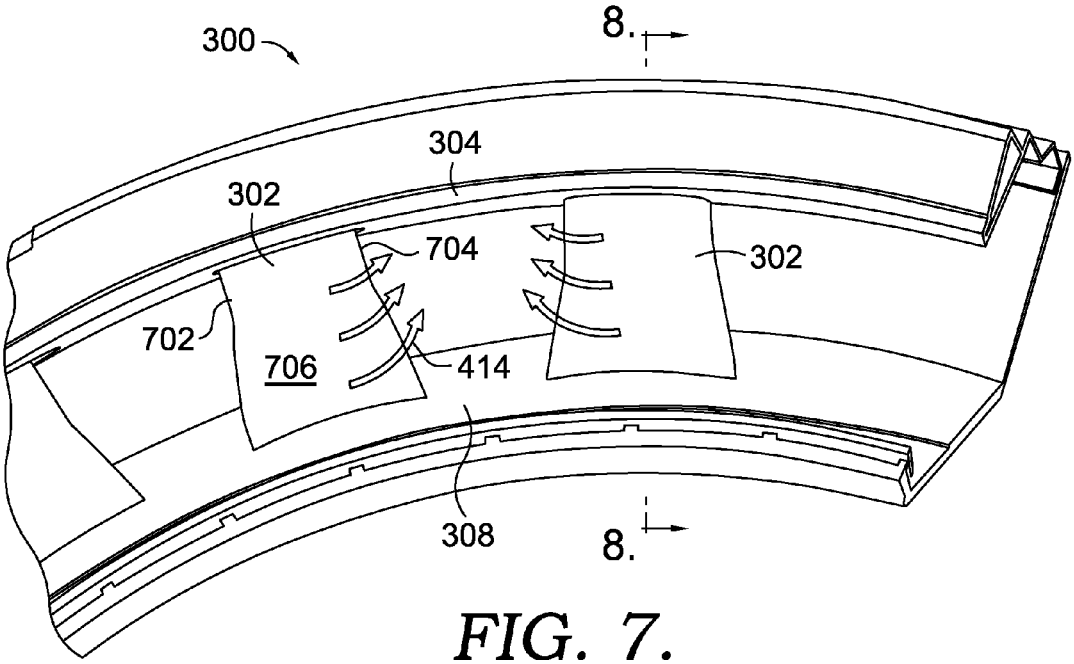
FIG. 7 illustrates a portion of the axial view of FIG. 3 and a representation of flow conditions in accordance with an embodiment of the present invention.
Figure 8:
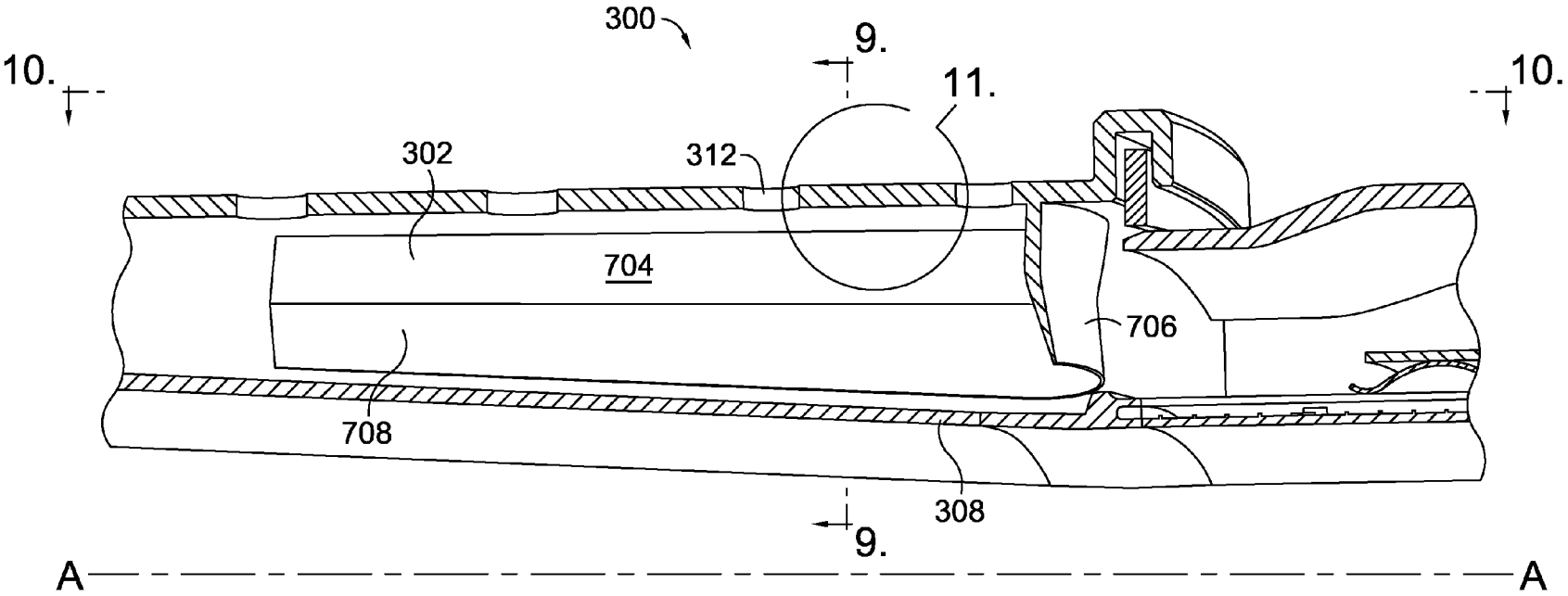
FIG. 8 illustrates a cross section view of the gas turbine combustor of FIG. 7.
Figure 9:
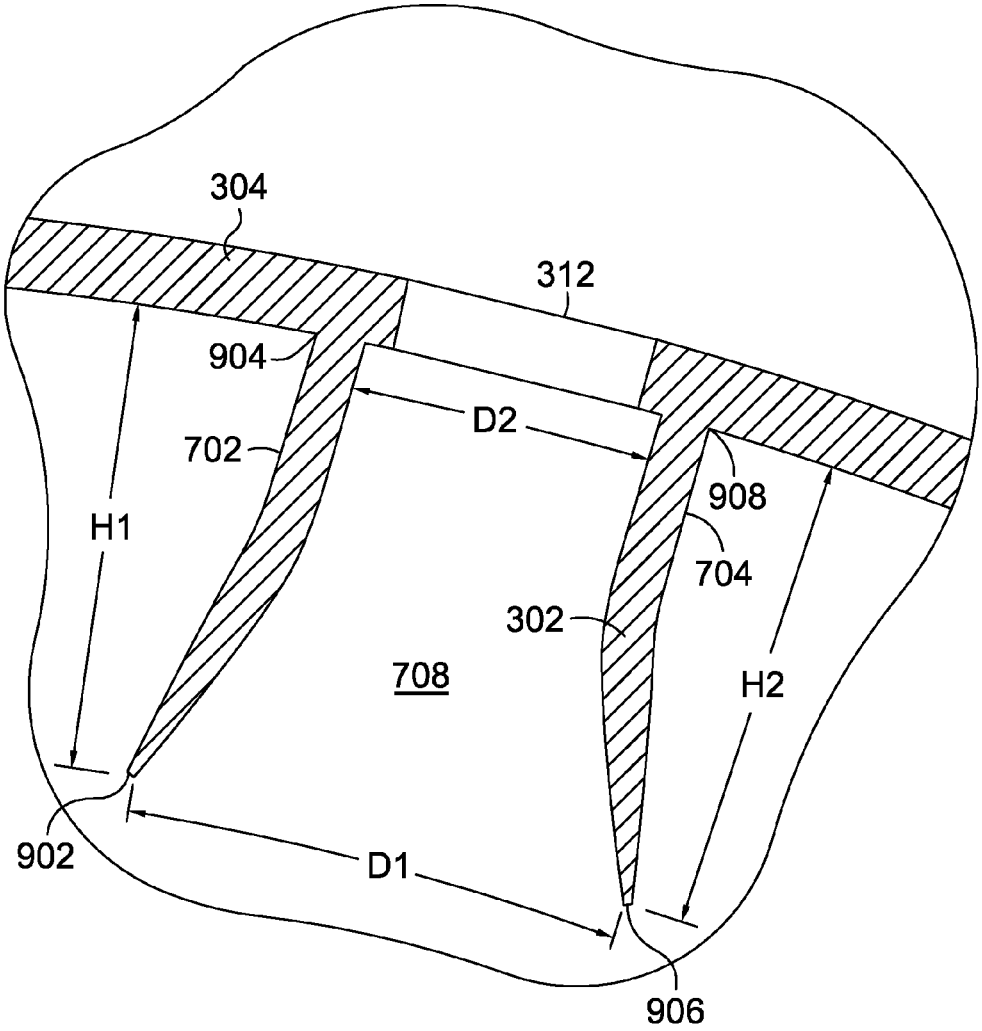
FIG. 9 illustrates an alternate cross section view taken through FIG. 7.

Referring to FIGS. 7-9, additional features of the deflector 302 are shown. FIG. 7 depicts an axial view of the combustor 300 viewed in the direction of the cross flow 414. FIG. 8 depicts an axial cross section through the deflector 302, while FIG. 9 depicts a longitudinal cross section through the deflector 302 better depicting the structure of the deflector 302. Structurally, flow sleeve deflector 302 has three distinct wall portions—a first wall 702 and a second wall 704 parallel to the first wall 702. Additionally, both the first wall 702 and second wall 704 are aligned generally parallel to the plurality of impingement holes 312, as shown in FIG. 9. Connecting the first wall 702 and the second wall 704 is a rounded front leading edge wall 706. The front leading edge wall 706 is located proximate an end of the flow sleeve 304, and is the first part of the deflector 302 to come into contact with cross flow 414 described above. The front leading edge wall 706 may alternatively feature an axially forward extending or an axially backward extending portion to further condition and redirect the cross flow 414. Referring to FIGS. 8 and 9, the first wall 702 has a length extending from a forward end to an aft end and a height H1 extending from a first edge 902 to a second edge 904, where the first edge 902 is radially inward of the second edge 904. It is important to note that the term "radially outward" and "radially inward" are defined with respect to center axis 310 discussed in FIG. 3. Therefore, the second edges 904 and 908 are radially outward and located further away from the center axis (306, FIG. 3) than the first edges 902 and 906. Additionally, it is contemplated that the distance D1 between the first edges 902 and 906 and the distance D2 between second edges 904 and 908 is variable depending on cooling performance needs. As shown in FIG. 9, the distance D1 between the first edges is greater than the distance D2 at the second edges. This configuration results in a portion of the first wall 702 being flared outward or away from the remaining unflared portion. The second wall 704 is spaced a distance from the first wall 702 and also has a length extending from a forward end to an aft end. The second wall 704 also has a height H2, as shown in FIG. 9, with a portion of the second wall 704 flared like the first wall 702. Similar to the first wall 702, the second wall 704 also has a first edge 906 and a second, radially outer edge 908, as shown in FIG. 9.

As it can be seen from FIGS. 5-8, the flow deflector 302 is closed at the forward ends of the first and second walls 702 and 704 by a rounded leading edge wall 706, and is open at the opposing aft end. The sidewalls (first wall 702 and second wall 704) together with the leading edge wall 706, when taken together, form a generally U-shaped elongated flow channel 708. As discussed above, and as shown in FIGS. 5-7, the flow deflector 302 is sized so as to encompass one or more cooling apertures 312.

As discussed herein, the flow deflector 302 provides a shield to deflect a cross flow 414 from adversely affecting the impingement cooling flow, as shown in FIG. 4. FIGS. 7 and 8, depict various cross sections of the gas turbine combustor 300 and how the flow deflector 302 interacts with the combustion liner 308 and the oncoming cross flow 414. As shown in FIG. 7, the cross flow 414 impacts the leading edge wall 706 and is directed radially outward by the flow deflector 302 and through a passageway effectively created by adjacent flow deflectors 302, thereby creating a more favorable condition for impingement flow 412 to provide more effective backside cooling on the combustion liner 308 as a result of having higher radial velocity compared to the prior art.

In addition to the increased impingement heat transfer effects in the impingement cooled zone of the combustion liner 308 due to the flow deflector 302, there is a difference in radial momentum generated in the flow annulus downstream of the flow deflector 302. This difference in radial flow momentum would cause a rotating flow to be formed between the deflected flow and impingement flow 412 downstream of the deflector 302. This increased rotational flow would beneficially affect the convective heat transfer effects downstream of the deflector 302, which in turn, beneficially affects the durability of the combustion liner 300. This rotational flow can be further enhanced with a variety of designs.

Figure 10:
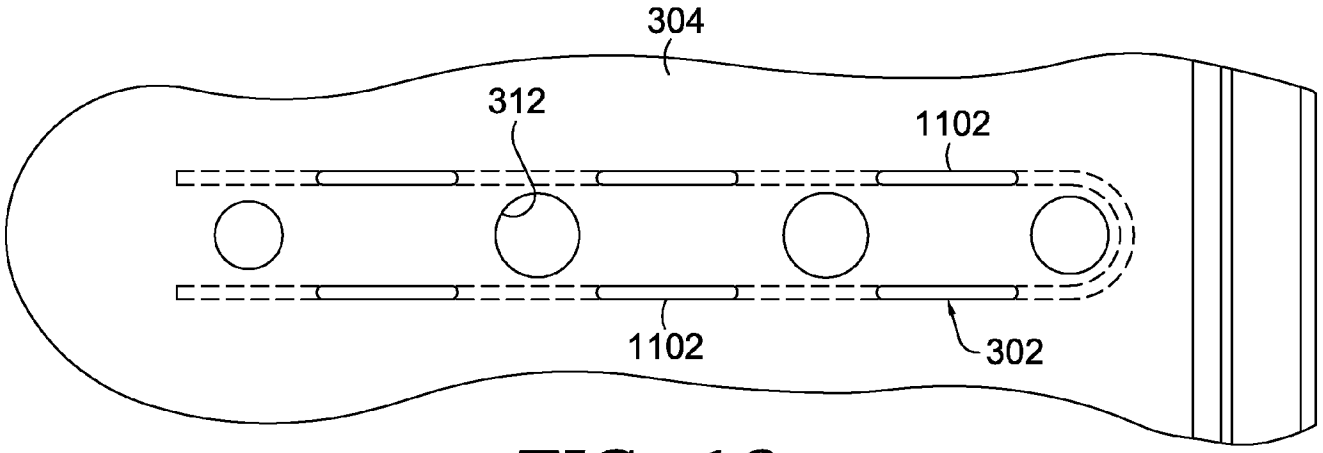
FIG. 10 illustrates a top elevation view of the portion of the gas turbine combustor of FIG. 7.
Figure 11:
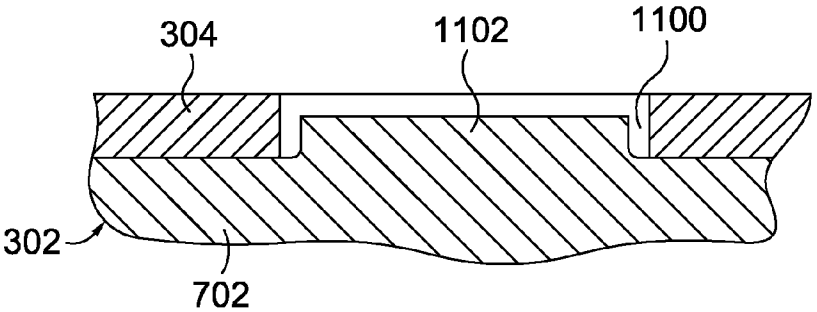
FIG. 11 illustrates a detailed view of a portion of the cross-section of FIG. 8.

Referring now to FIG. 10, a top elevation view of a portion of the flow sleeve 304 is depicted. In this view, the flow deflector 302 is represented by a combination of solid and hidden lines. The flow deflector 302 is preferably secured to the flow sleeve 304 by a variety of means such as brazing or welding. To improve the integrity of the joint between the flow deflector 302 and the flow sleeve 304, the flow sleeve 304 comprises one or more mounting slots 1100, as shown in FIG. 11. The flow deflector 302 also comprises a corresponding one or more mounting tabs 1102. The one or more mounting tabs 1102 extend upward from a wall 702 and/or 704 of the flow deflector 302. To further improve the structural integrity of the joint between the flow sleeve 304 and the flow deflector 302, it is preferred that the mounting tabs 1102 are integral to the wall 702/704 of the flow deflector 302.

The mounting tabs 1102 are inserted into mounting slots 1100. Then, mounting tabs 1102 are fixed to the flow sleeve 304 via a common joining process known in the art, such as plug welding. In addition, the remaining "non-tabbed" portion of the flow deflector 302 may also be secured to the flow sleeve. The technique used for affixing the "non-tabbed" portion of the flow deflector 302 to the flow sleeve 304 is typically fillet welding and/or brazing, although any means of coupling that provides the necessary bonding strength can be substituted instead.

It will be understood that certain features and subcombinations are of utility and may be employed without reference to other features and subcombinations. This is contemplated by and is within the scope of the claims. Since many possible embodiments may be made of the invention without departing from the scope thereof, it is to be understood that all matter herein set forth or shown in the accompanying drawings is to be interpreted as illustrative and not in a limiting sense.

Having thus described the invention, what is claimed is:

1. A gas turbine combustion system comprising:

a combustion liner having a center axis and a first diameter;

a flow sleeve extending coaxial with the combustion liner having a second diameter, the second diameter greater than the first diameter thereby forming a first flow annulus therebetween, the flow sleeve having a plurality of rows of circumferentially spaced cooling apertures, wherein the cooling apertures are through-holes located in an outermost cylindrical wall of the flow sleeve; and, one or more flow deflectors secured to an inner surface of the outermost cylindrical wall of the flow sleeve and extending radially inward from the outermost cylindrical wall of the flow sleeve forming an axially elongated flow channel, the one or more flow deflectors having two sidewalls connected by a forward wall, each sidewall having a radially inward edge and a radially outward edge adjacent a radially inner wall of the flow sleeve, a first distance separates inner surfaces of the radially inward edges and a second distance separates inner surfaces of the radially outward edges, each sidewall flaring towards an adjacent flow deflector such that the first distance is greater than the second distance, wherein the two sidewalls are directly connected to, and extend radially inward from, the inner surface of the outermost cylindrical wall of the flow sleeve.

2. The gas turbine combustion system of claim 1, wherein the one or more flow deflectors direct a supply of air from a plurality of rows of cooling apertures in a radial direction.

3. The gas turbine combustion system of claim 2, wherein the forward wall is rounded.

4. The gas turbine combustion system of claim 1, wherein multiple spaced cooling apertures supply air to the axially elongated flow channel.

5. The gas turbine combustion system of claim 1, wherein the one or more flow deflectors further comprises a plurality of mounting tabs and the outermost cylindrical wall of the flow sleeve further comprises a plurality of mounting slots for receiving the mounting tabs.

6. A flow sleeve of a gas turbine combustor comprising, a generally cylindrical body having a center axis;

a plurality of cooling apertures located along the generally cylindrical body, the plurality of cooling apertures oriented in a series of circumferentially-spaced rows, and the plurality of cooling apertures being through-holes located in an outermost cylindrical wall of the generally cylindrical body; and, a plurality of flow deflectors fixed to an inner surface of the outermost cylindrical wall of the generally cylindrical body, the flow deflectors comprising a pair of radially inwardly-extending sidewalls having an axial length connected by a rounded front leading edge wall, the pair of sidewalls having radially inward edges and radially outward edges adjacent the inner surface of the outermost cylindrical wall of the generally cylindrical body, where a distance between inner surfaces of the radially inward edges of the flow deflector walls is larger than a distance between inner surfaces of the radially outward edges of the flow deflector walls, wherein the flow deflector further comprises one or more mounting tabs, wherein the outermost cylindrical wall of the generally cylindrical body further comprises one or more mounting slots for receiving the one or more mounting tabs, the slots being through-holes located in the outermost cylindrical wall of the generally cylindrical body, and wherein the flow deflector is secured to the outermost cylindrical wall of the generally cylindrical body at the one or more mounting slots.

7. The flow sleeve of claim 6, wherein an axial length of the flow deflectors is greater than the distance between the inner surfaces of the radially inward edges.

8. The flow sleeve of claim 6, wherein the deflector captures air from one or more apertures in each of the circumferentially-spaced rows.

9. The flow sleeve of claim 6, wherein a portion of the sidewalls taper outwardly towards an adjacent flow deflector.

10. A flow deflector for use in a gas turbine combustor comprising:

a first wall having a first length extending from a forward end of the first wall to an aft end of the first wall and a first height extending from a first edge of the first wall to an opposing second edge of the first wall;

a second wall spaced from the first wall, the second wall having a second length extending form a forward end of the second wall to an aft end of the second wall and a second height extending from a first edge of the second wall to a second edge of the second wall;

wherein a portion of the first wall flares outwardly from the first edge of the first wall to the opposing second edge of the first wall and a portion of the second wall flares outwardly from the first edge of the second wall to the opposing second edge of the second wall such that a distance between inner surfaces of first and second wall at the second edges of the first and second wall is greater than a distance between inner surfaces of the first and second wall at the first edges of the first and second wall; and, a leading edge wall connecting the first wall to the second wall to form a generally U-shaped elongated flow channel for encompassing a plurality of cooling apertures, wherein the generally U-shaped elongated flow channel is directly connected to, and extends radially inward from, an inner surface of an outermost cylindrical wall of a flow sleeve of the gas turbine combustor, the outermost cylindrical wall of the flow sleeve having a plurality of rows of circumferentially spaced cooling apertures.

11. The flow deflector of claim 10, wherein the flare of the first wall is equivalent to the flare of the second wall.

12. The flow deflector of claim 10, wherein the first wall further comprises a plurality of first mounting tabs extending from the first edge of the first wall, and wherein the second wall further comprise a plurality of first mounting tabs extending from the first edge of the second wall.

13. The flow deflector of claim 10 provided a shield for cooling air being injected into a region between the flow sleeve and a combustion liner.

14. The flow deflector of claim 13, wherein the distance between the inner surfaces of the first and second wall at the first edges of the first wall and the second wall is greater than a diameter of an aperture providing the cooling air.

15. The flow deflector of claim 10, wherein the leading edge wall is rounded.

16. The flow deflector of claim 10, wherein the leading edge wall has an axially forward extending portion or an axially rearward extending portion.

* * * * *